US007658696B2

(12) United States Patent
Hunter

(10) Patent No.: US 7,658,696 B2
(45) Date of Patent: Feb. 9, 2010

(54) MULTIPURPOSE THERAPEUTIC DEVICE

(76) Inventor: Brett Hunter, 22105 - 67th Pl., Mountlake Terrace, WA (US) 98043

( * ) Notice: Subject to any disclaimer, the term of this patent is extended or adjusted under 35 U.S.C. 154(b) by 0 days.

(21) Appl. No.: 12/355,545

(22) Filed: Jan. 16, 2009

(65) Prior Publication Data

US 2009/0124468 A1 May 14, 2009

Related U.S. Application Data

(63) Continuation-in-part of application No. 11/796,305, filed on Apr. 27, 2007, now abandoned.

(51) Int. Cl.
*A63B 23/025* (2006.01)
*A63B 21/00* (2006.01)

(52) U.S. Cl. ..... 482/10; 482/131; 482/907

(58) Field of Classification Search ..... 482/10–11, 482/51, 69, 91–93, 105, 121–126, 131–132, 482/139–140, 148, 907; 54/3, 77; 441/65, 441/129, 132; 601/39, 133–138; 606/201, 606/204; 128/845; D21/662, 683; D24/214–215
See application file for complete search history.

(56) References Cited

U.S. PATENT DOCUMENTS 2,956,616 A * 10/1960 Labusky ..... 482/69
D299,373 S * 1/1989 Parker et al. ..... D21/682
5,267,931 A * 12/1993 Faetini ..... 482/140
6,582,347 B2 * 6/2003 Smith ..... 482/140

* cited by examiner

*Primary Examiner*—Loan H Thanh
*Assistant Examiner*—Oren Ginsberg
(74) *Attorney, Agent, or Firm*—Dale J. Ream

(57) ABSTRACT

Various embodiments of the present invention are directed to a multipurpose therapeutic device for managing musculoskeletal pain and administering traction. In one embodiment of the present invention, a multipurpose therapeutic device includes a front side, a rear side, a first end, and a second end. An outer gripping surface is positioned in proximity to each of the two ends and a number of invaginating contact surfaces extend from the perimeter of the front side and/or the rear side. In one embodiment of the present invention, a user may place his or her neck against one of the contact surfaces. The user may then grip the outer gripping surfaces with his or her hands and move the multipurpose therapeutic device superiorly and inferiorly along his or her neck while applying pressure against his or her neck to massage sore neck muscles or to stretch his or her spine.

3 Claims, 17 Drawing Sheets

MULTIPURPOSE THERAPEUTIC DEVICE

CROSS-REFERENCE TO RELATED APPLICATIONS

This application is a continuation-in-part application that claims the benefit of U.S. application Ser. No. 11/796,305 filed Apr. 27, 2007, now abandoned entitled Multipurpose Therapeutic Device.

TECHNICAL FIELD

The present invention relates to the field of therapeutic devices, and, in particular, to a multipurpose therapeutic device.

BACKGROUND OF THE INVENTION

Many people suffer the ill effects of musculoskeletal pain. Musculoskeletal pain may be caused by a number of different factors, including muscle strain and tension, degenerative disc disease, herniated discs, overexertion, fatigue, arthritis, whiplash, vertebral fractures, and other musculoskeletal-pain-causing factors. Some people try and manage musculoskeletal pain by using nonprescription non-steroidal anti-inflammatory drugs ("NSAIDs"), including ibuprofen, aspirin, acetaminophen, topical ointments, and other NSAIDs. Certain home remedies are often used as well, including applying heat and/or ice to the painful area, performing slow range-of-motion exercises, having a partner gently massage the sore or painful areas, and sleeping on a firm mattress with one or more therapeutic pillows, such as a neck pillow, body pillow, or other type of therapeutic pillow.

However, some musculoskeletal pain cannot be managed entirely by using NSAIDs and home remedies. Accordingly, some musculoskeletal pain sufferers opt to visit a health practitioner, such as a physician, a physical therapist, a massage therapist, or a chiropractor to manage pain. A physician may be able to manage musculoskeletal pain by prescribing local muscle relaxants and/or analgesics, applying electrical stimulation to muscle tissues, administering bed or table traction, performing surgery, fitting a patient with a device to minimize movement, and/or prescribing specific exercises, stretches, and physical therapy. A massage therapist may be able to manage muscle pain by applying pressure, tension, motion, and/or vibration to soft painful muscles or muscle groups, tendons, ligaments, and joints. A chiropractor may be able to manage pain from mechanical disorders of the spine and musculoskeletal system by making adjustments to a patient's spine.

Patients with prolonged or chronic musculoskeletal pain may try to manage the pain by combining the application of a number of different home remedies with regular therapy sessions with one or more different types of health practitioners. However, frequently scheduling appointments with health practitioners can be aggravating. Therapists and/or therapeutic equipment may not available when therapy is needed. Also, regularly attending therapeutic sessions at remote locations may be inconvenient and time-consuming. Additionally, the cost of regular therapy sessions may be too expensive for many people to afford.

Spinal traction devices are commonly used to stretch, decompress, and unload a Patient's spine to manage certain types of musculoskeletal pain. Spinal traction devices often utilize gravity or weights to apply tension to a patient in order to alleviate compressive forces on a patient's spine. However, spinal traction devices often involve cumbersome straps and supports and/or complicated weight-and-pulley systems. Additionally, controlling the amount of force employed by many spinal traction devices can be difficult. Excessive force can cause additional pain and injury while insufficient force may provide no benefit to a user. People suffering the ill effects of musculoskeletal pain have, therefore, recognized a need for a device that can be used outside of a clinical setting for managing musculoskeletal pain and administering traction.

SUMMARY OF THE INVENTION

Various embodiments of the present invention are directed to a multipurpose therapeutic device for managing musculoskeletal pain and administering traction. In one embodiment of the present invention, a multipurpose therapeutic device includes a front side, a rear side, a first end, and a second end. An outer gripping surface is positioned in proximity to each of the two ends and a number of invaginating contact surfaces (aka "cutouts") extend from the perimeter of the front side and/or the rear side. In one embodiment of the present invention, a user may place his or her neck against one of the contact surfaces. The user may grip the outer gripping surfaces with his or her hands and move the multipurpose therapeutic device superiorly and inferiorly along his or her neck in a number of different ways to massage and stretch muscles or to stretch his or her spine.

DETAILED DESCRIPTION OF THE INVENTION

Various embodiments of the present invention are directed to a multipurpose therapeutic device for managing musculoskeletal pain and administering traction. In one embodiment of the present invention, a user of a multipurpose therapeutic device ("user") may self-manage musculoskeletal pain in one or more effected areas by grasping a multipurpose therapeutic device ("therapeutic device"), placing the effected area against a contact surface along the perimeter of the therapeutic device, and repeatedly rubbing, rasping, or grinding ("massaging") the effected area with the therapeutic device. In another embodiment of the present invention, a user may self-administer traction to the cervical region of his or her spine by placing his or her neck against a contact surface along the perimeter of a therapeutic device and using his or her hands to apply pressure against the therapeutic device in a superior direction to stretch his or her spine.

Figure 1:
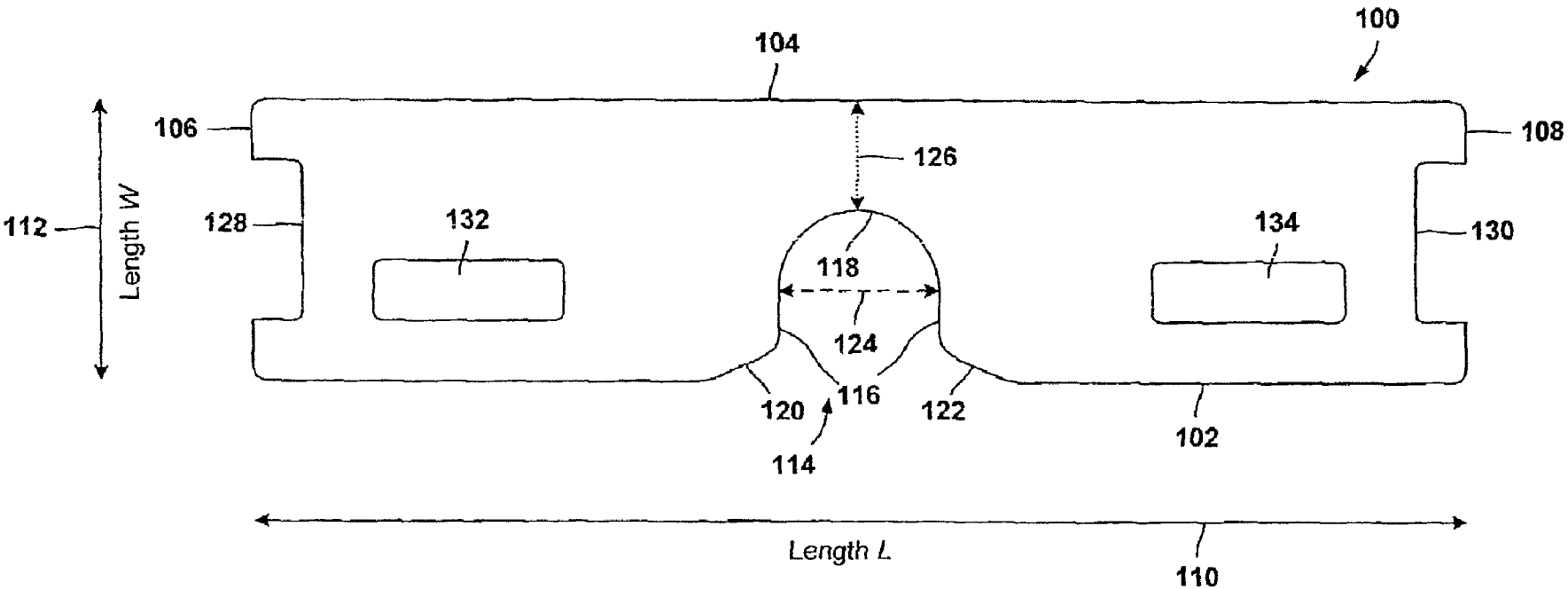
FIG. 1 shows a top view of a therapeutic device that represents one embodiment of the present invention.

FIG. 1 shows a top view of a therapeutic device that represents one embodiment of the present invention. A therapeutic device 100 includes a device body having a generally rectangular configuration, the device body including a first face 202, an opposed second face 204 (which may also referred as top and bottom faces) (FIG. 2*a*, 2*b*), a front side 102 (also referred to as a front edge), a rear side 104 (also referred to as rear edge) that is opposite to the front side 102, a first end 106 that is approximately orthogonal to the front side 102, and a second end 108 that is opposite to the first end 106. The front side/edge 102 is generally parallel to the rear side/edge 104 and the first end 106 is generally parallel to the second end 108. The front side 102 is a length L 110, shown in FIG. 1 as a line with an arrow at each end. The rear side 104 is a length approximately equal to length L 110. The first end 106 is a width W 112, shown in FIG. 1 as a line with an arrow at each end. The second end 108 is a length approximately equal to width W 112. Accordingly, the therapeutic device 100 shown in FIG. 1 is substantially rectangular in shape. Additionally, in FIG. 1, length L 110 is approximately four times longer than width W 112. In alternate embodiments of the present invention, the ratio of length L to width W is another ratio other than approximately four to one, such as approximately three to one, or approximately five-and-a-half to one, or some other approximate ratio.

The front side/edge 102 defines a first cutout 114 having a generally annular configuration capable of receiving a neck therein. The first cutout 114 extends inward along the perimeter of the front side/edge 102 in proximity of the center of the length L 110. The first cutout 114 includes two proximal portions 116 and a distal portion 118. The proximal portions 116 include a first tapered portion 120 and a second tapered portion 122. The width 124 of the front contact surface 114, shown in FIG. 1 as a dashed line with an arrow at both ends, may be sized to fit various portions of a user's body, including a lower head, neck, shoulder, upper limb, and lower limb. The distance 126 between the distal portion 118 of the front contact surface 114 and the rear side 104, shown in FIG. 1 as a dotted line with an arrow at both ends, may be sized for use by a user when the rear side 104 of the therapeutic device is positioned against a firm surface, as discussed below with reference to FIG. 6. It should be appreciated that the first cutout is situated and configured to receive a user's neck or upper head when the device body is positioned with the top surface 101 generally horizontal to a ground or floor surface.

As shown in FIG. 1, the therapeutic device 100 further includes a first outer gripping surface 128 in proximity to the first end 106 and a second outer gripping surface 130 in proximity to the second end 108 (the gripping surfaces also referred to as inner and outer grips, respectively). In FIG. 1, the first outer gripping surface 128 and the second outer gripping surface 130 are shown as cutouts in the first end 106 and the second end 108, respectively. It should be noticed that each of the first and second outer gripping surfaces include a free surface not confined or covered by any other surface. The therapeutic device 100 also includes a first inner gripping surface 132 on the therapeutic device 100 between the first end 106 and the first cutout 114, and a second inner gripping surface 134 on the therapeutic device 100 between the second end 108 and the first cutout 114. In FIG. 1, the first inner gripping surface 132 and the second inner gripping surface 134 are shown as apertures in the therapeutic device 100 and may also be referred to as first and second gripping apertures.

Figures 2A, 2B:
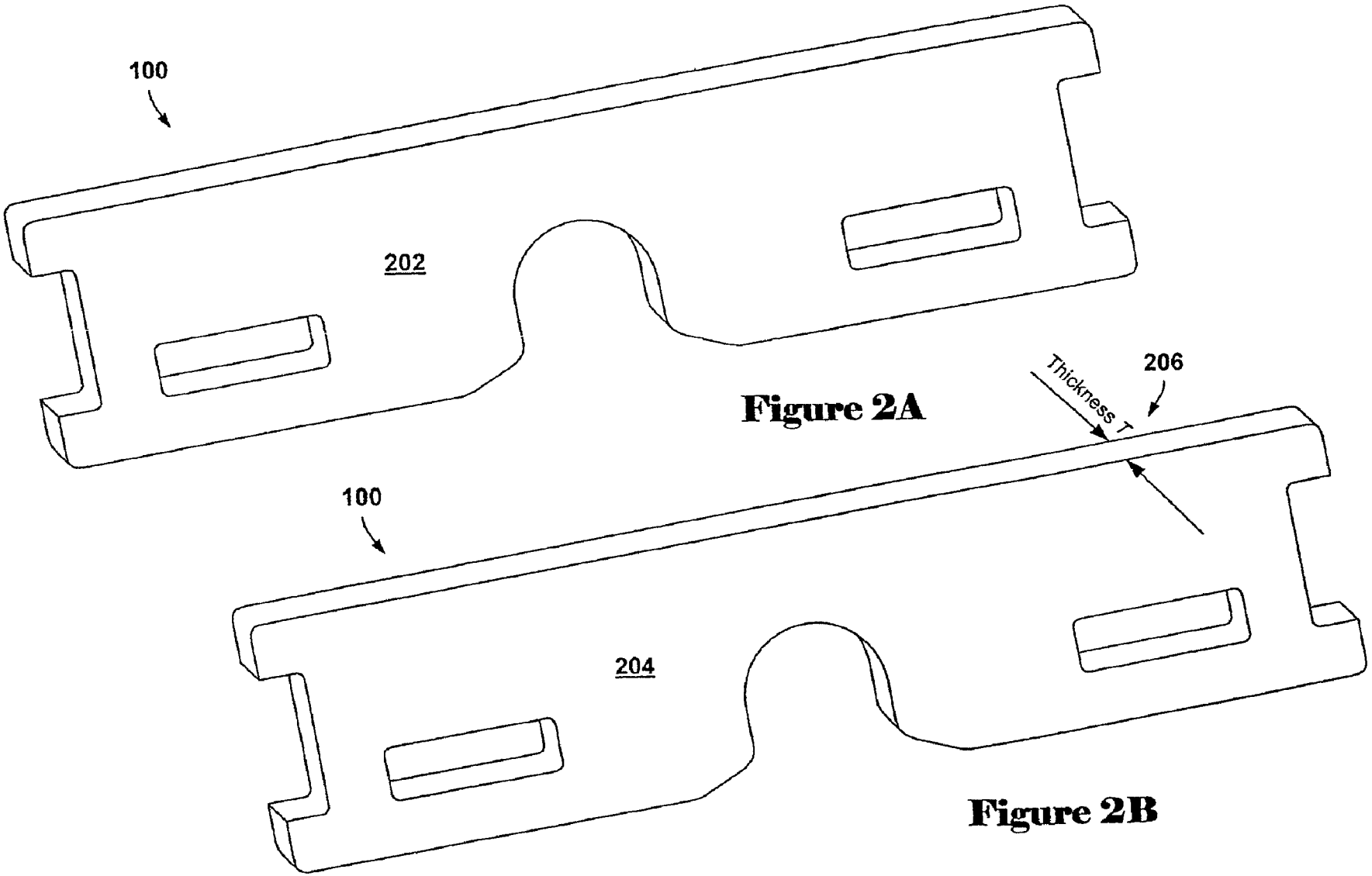
FIG. 2A shows a perspective view of a first face of the therapeutic device shown in FIG. 1 that represents one embodiment of the present invention.
FIG. 2B shows a perspective view of a second face of the therapeutic device shown in FIG. 1 that represents one embodiment of the present invention.

FIG. 2A shows a perspective view of a first face of the therapeutic device shown in FIG. 1 that represents one embodiment of the present invention. The therapeutic device 100 includes a first face 202. In the embodiment of the present invention shown in FIG. 2A, the first face 202 is relatively flat or planar. FIG. 2B shows a perspective view of a second face of the therapeutic device shown in FIG. 1 that represents one embodiment of the present invention. The therapeutic device 100 includes a second face 204. In the embodiment of the present invention shown in FIG. 2A, the second face 204 is generally flat and is similar in shape to the first face 202. Additionally, as shown in FIGS. 2A-2B, the therapeutic device 100 has a consistent thickness T 206, shown in FIG. 2B as the space between two lines pointing inwards to each other. Accordingly, the embodiment of the present invention shown in FIGS. 2A-2B is substantially planar.

In alternate embodiments of the present invention, one or more of the first face 202 and the second face 204 contain projections, prominences, protrusions, ribs, hills, bumps, holes, cracks, fissures, channels, indentations, grit, ruts, and/or grooves ("massage surfaces") to provide additional contact surfaces for massaging a region of a user's body. In one embodiment of the invention, the first face 202 is flat and the second face 204 contains massage surfaces. In another embodiment of the present invention, both the first face 202 and the second face 204 contain massage surfaces. Note that the massage surfaces may be fabricated as part of a therapeutic device or may be fabricated separately and subsequently interconnected to a therapeutic device. For example, massage surfaces can be part of an adhesive surface that can be adhered to one or more faces of a therapeutic device. Alternately, massage surfaces can be attached to a therapeutic device by other means, including nails, screws, ropes, string, hook and loop fasteners, snaps, epoxy, zippers, and other attachment means. In alternate embodiments of the present invention, the front side, rear side, first end, and second end of a therapeutic device may also include massage surfaces, such as a series of knobs extending from one or more of the sides and/or ends.

Figure 3A:
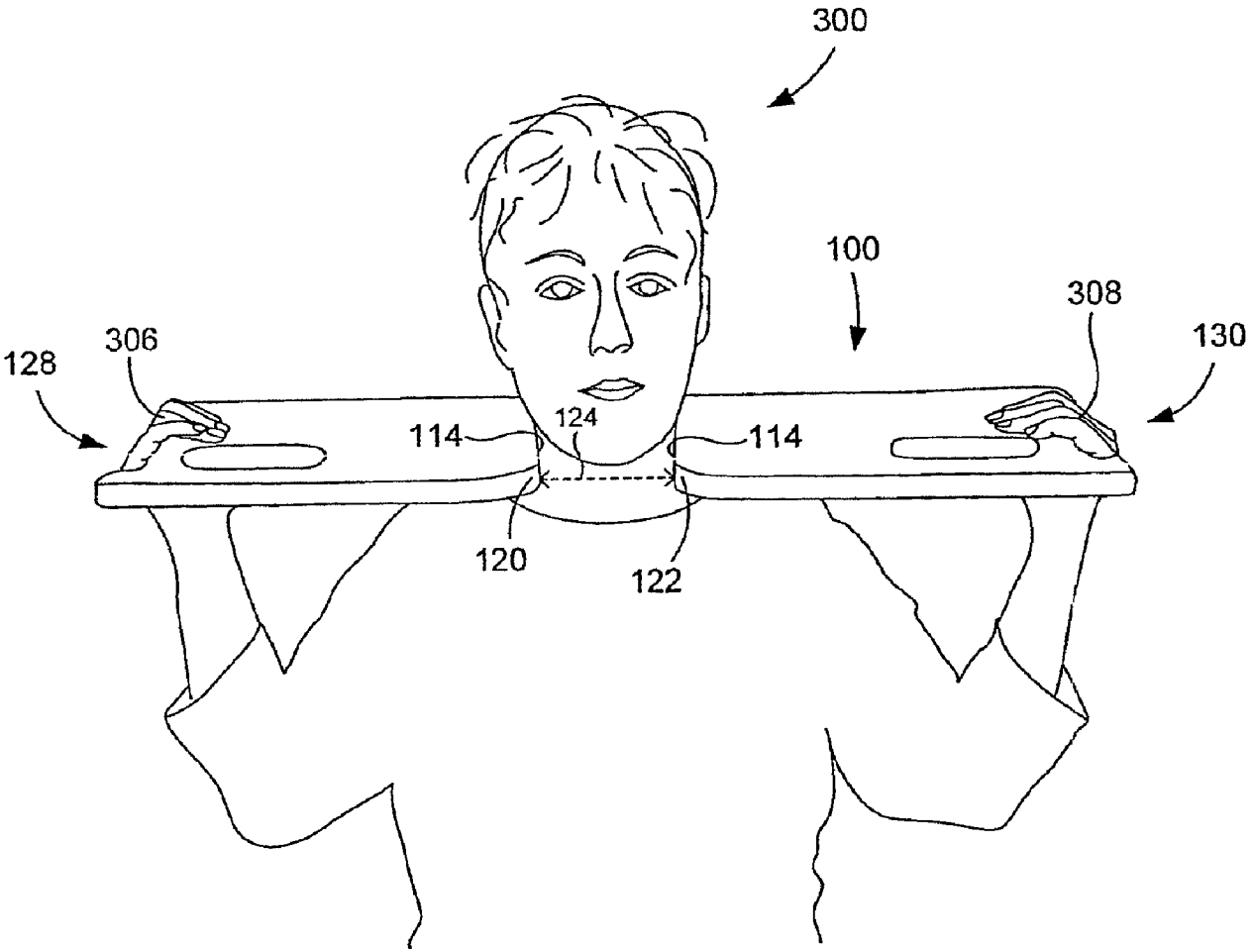
FIG. 3A shows a front view of a user utilizing outer gripping surfaces while massaging her neck with the therapeutic device shown in FIG. 1 that represents one embodiment of the present invention.
Figure 3B:
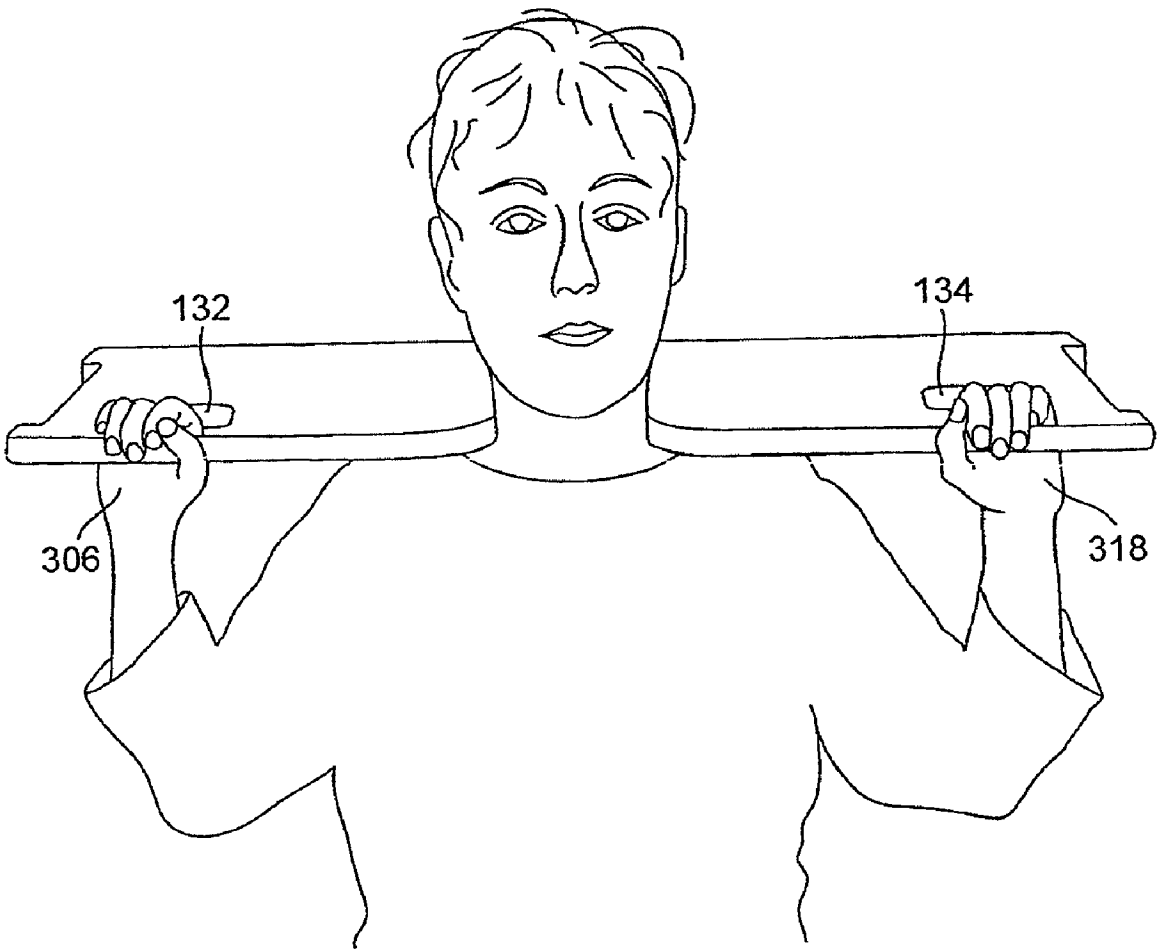
FIG. 3B shows a front view of a user utilizing inner gripping surfaces while massaging her neck with the therapeutic device shown in FIG. 1 that represents one embodiment of the present invention.

In one embodiment of the present invention, a front contact surface of a therapeutic device is sized to fit the neck of a user and may be used to massage the muscles of the user's lower head, upper shoulders, and neck and/or stretch the cervical portion of the user's spine. Many different muscle groups in the neck and head can be massaged using a therapeutic device, including the sternocleidomastoid, trapezium, sternohyoid, digastric, masseter, buccinator, and other muscle groups in the head and neck. FIG. 3A shows a front view of a user utilizing outer gripping surfaces while massaging her neck with the therapeutic device shown in FIG. 1 that represents one embodiment of the present invention. In FIG. 3A, a user 300 is shown using the therapeutic device 100. The user's neck 402 is contacting the first cutout 114 and the user's hands 306 and 308 are grasping the first outer gripping surface 128 and the second outer gripping surface 130, respectively. The user's neck 402 may be placed in contact with the first cutout 114 by placing the therapeutic device 100 behind the posterior portion of the user's neck 402 and moving the therapeutic device 100 anteriorly until the posterior portion of the therapeutic device 100 contacts the distal portion 118 (not shown in FIG. 3A) of the front contact surface 114. The therapeutic device 100 is sized such that the first cutout 114 fits snugly around the posterior half of the user's neck. In FIG. 3A, the diameter of the widest portion of the coronal plane of the user's neck 302 is roughly equivalent to the width 124 of the front contact surface 114. The first tapered portion 120 and the second tapered portion 122 provide an opening that is greater in length than the width 124 of the first cutout 114 and can be used to guide the first cutout 114 around the user's neck 302. FIG. 3B shows a front view of a user utilizing inner gripping surfaces while massaging her neck with the therapeutic device shown in FIG. 1 that represents one embodiment of the present invention. In FIG. 3B, the user's hands 306 and 308 are grasping the first inner gripping surface/aperture 132 and the second inner gripping surface/aperture 134, respectively.

Figure 4A:
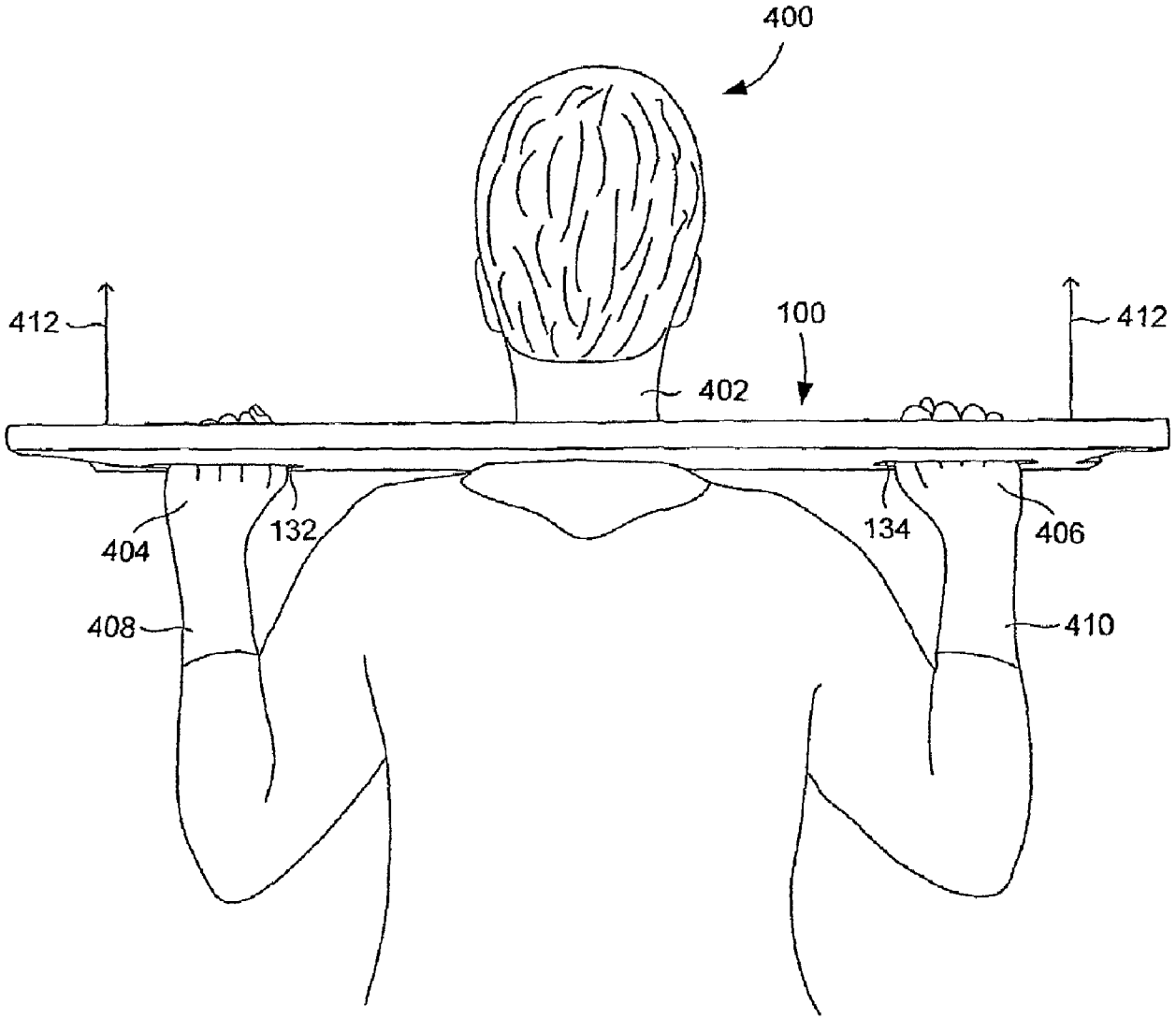
FIG. 4A shows a rear view of a user massaging the inferior portion of her neck using the therapeutic device shown in FIG. 1 that represents one embodiment of the present invention.
Figure 4B:
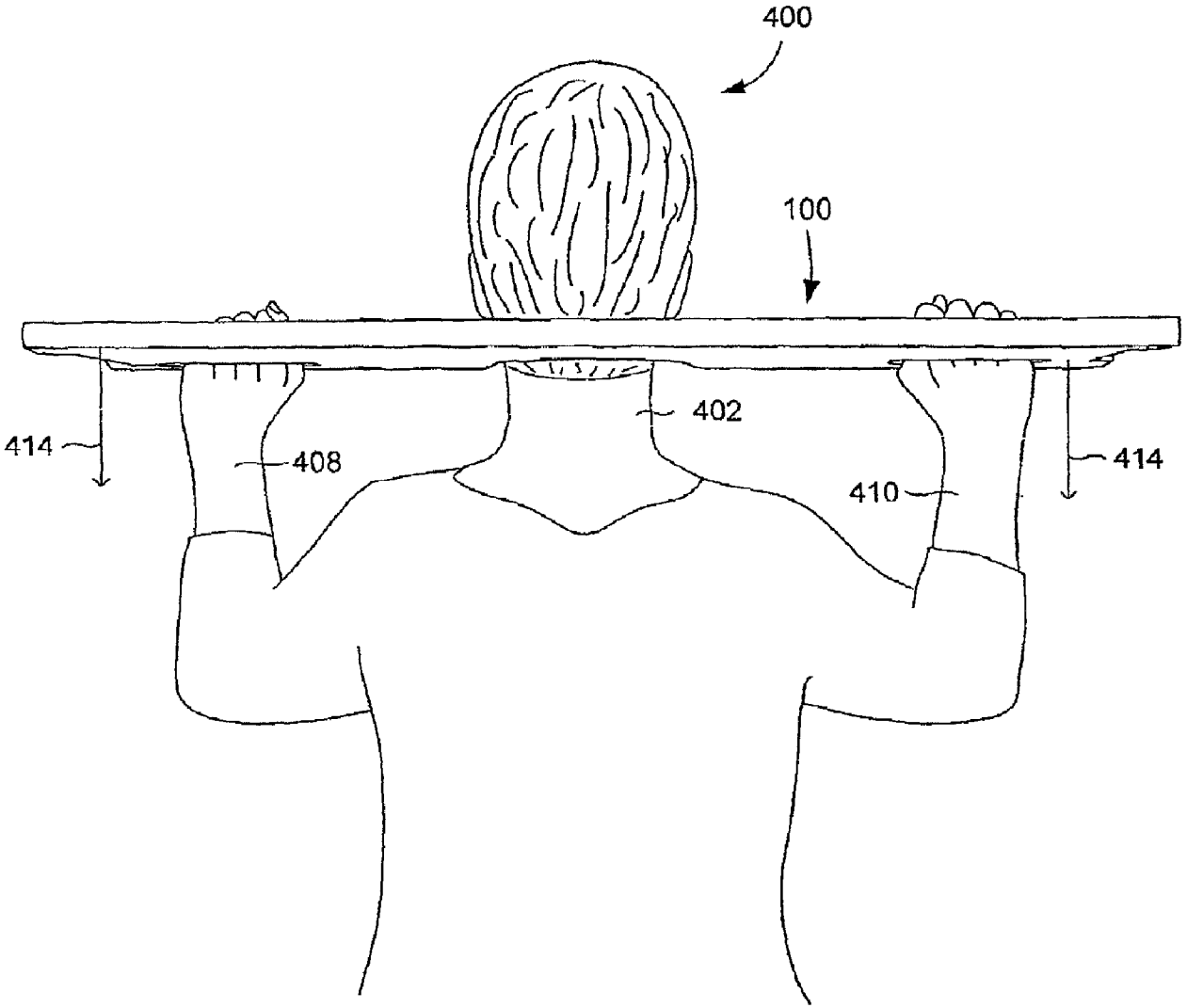
FIG. 4B shows a rear view of a user massaging the superior portion of her neck using the therapeutic device shown in FIG. 1 that represents one embodiment of the present invention.

FIG. 4A shows a rear view of a user massaging the inferior portion of her neck using the therapeutic device shown in FIG. 1 that represents one embodiment of the present invention. In FIG. 4A, a user 400 is shown using the therapeutic device 100. The first cutout 114 of the therapeutic device 100 is positioned against the inferior portion of the user's neck 402 and the user's hands 404 and 406 are placed in the inner gripping surfaces/apertures 132 and 134, respectively. The user 400 may use her arms 408 and 410 to move the therapeutic device 100 superiorly along her neck 402, as shown in FIG. 4A by directional arrows 412. FIG. 4B shows a rear view of a user massaging the superior portion of her neck using the therapeutic device shown in FIG. 1 that represents one embodiment of the present invention. Once the user 400 has the first cutout 114 of the therapeutic device 100 positioned against the superior portion of her neck 402, as shown in FIG. 4B, the user 400 may also use her arms 408 and 410 to move the therapeutic device 100 in an inferior direction along her neck 402, as shown in FIG. 4B by directional arrows 414.

Figure 4C:
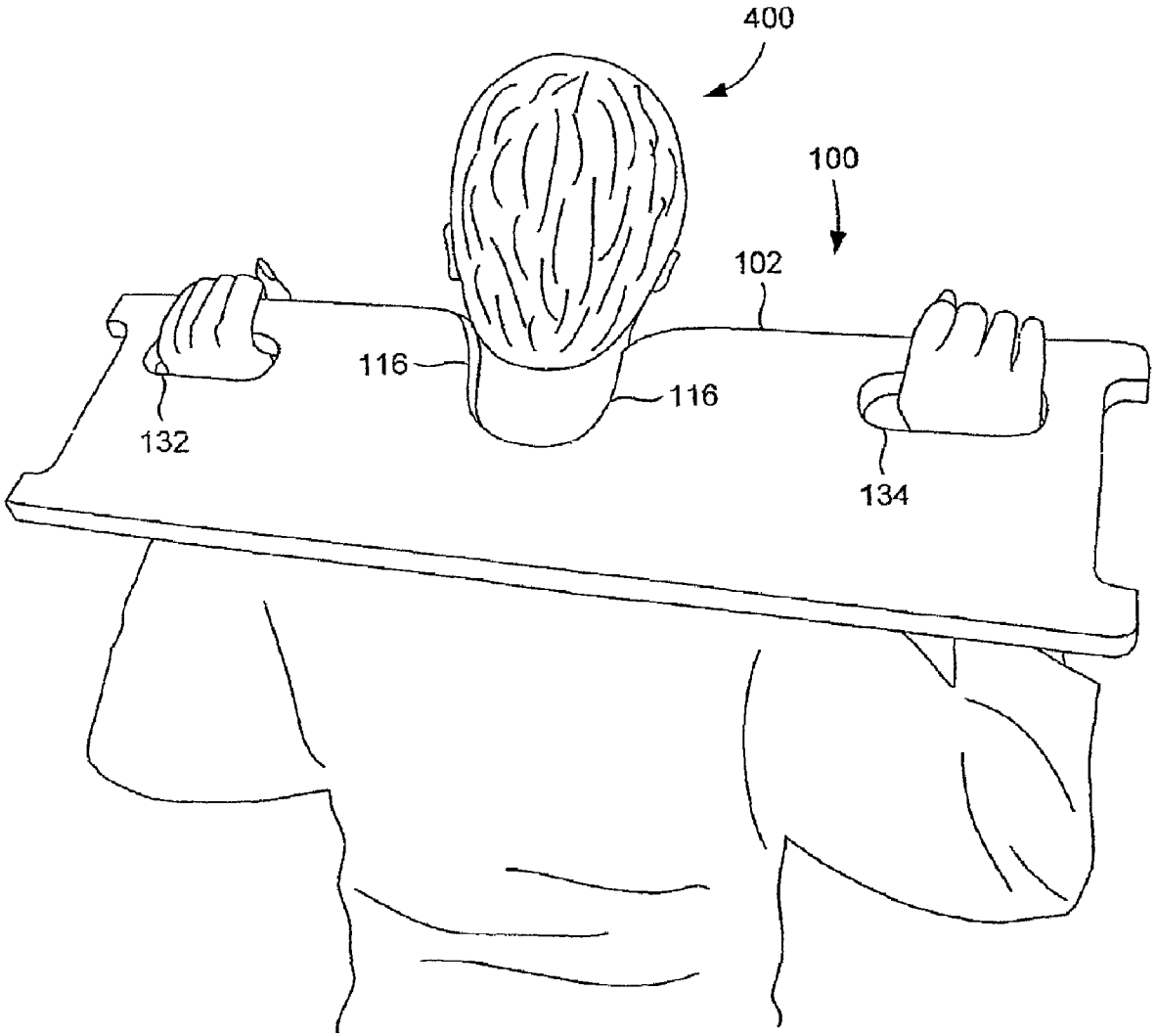
FIG. 4C shows a rear view of a user massaging her neck by angling the therapeutic device shown in FIG. 1 that represents one embodiment of the present invention.

A user can use a therapeutic device to apply various amounts of pressure against his or her neck while moving the therapeutic device superiorly and inferiorly along his or her neck. The amount of pressure applied to muscle groups can be controlled by controlling the amount of force with which a user applies anteriorly while moving the therapeutic device superiorly and inferiorly along his or her neck. A user may also use various angling techniques to move a therapeutic device over various portions of the user's neck. FIG. 4C shows a rear view of a user massaging her neck by angling the therapeutic device shown in FIG. 1 that represents one embodiment of the present invention. In FIG. 4C, the therapeutic device 100 is shown angled such that the front side 102 of the therapeutic device 100 is superior (higher) to the rear side 104. The user 400 may also angle the therapeutic device 100 such that the front side 102 is inferior (lower) to the rear side 104. The user 400 may hold the rear side 104 stationary and pivot the front side 102 to a superior and/or inferior position to massage the anterior lateral portions of the user's neck with the proximal portions 116 of the therapeutic device 100. For example, the therapeutic device 100 can be used to massage the muscles of the jaw, such as the masseter and the buccinator.

Alternately, the user 400 can hold the front side 102 stationary and pivot the rear side 104 to a superior and/or inferior position to massage the posterior portions of the user's neck with the distal portion 118 of the therapeutic device 100. For example, the therapeutic device 100 can be passed over the muscles of the lower neck, such as the lower portions of the sternocleidomastoid and the trapezius muscles. The user 400 can also pivot the therapeutic device 100 such that the front side 102 moves in a superior direction along the user's neck while the rear side 104 moves in an inferior direction, or conversely, pivot the therapeutic device 100 such that the front side 102 moves in an inferior direction while the rear side 104 moves in a superior direction. Note that, in FIGS. 4A-4C the user 400 is shown gripping the inner gripping surfaces 132 and 134. However, either the inner gripping surfaces 132 and 134 (inner apertures) or the outer gripping surfaces 128 and 130 (inner and outer cutouts) may be used for gripping the therapeutic device 100. Additionally, the user 400 may grip the therapeutic device 100 anywhere on the therapeutic device 100 to control the movement of the therapeutic device 100.

A user may apply pressure to his or her neck in a number of different directions while moving a therapeutic device superiorly and inferiorly along the length of his or her neck. By applying pressure in various directions roughly orthogonal to the length of a user's neck, the user may selectively apply pressure to desired muscle groups while avoiding application of pressure to undesired muscle groups. Additionally, selective application of pressure to certain muscle groups may be accomplished by rotating a therapeutic device in a plane orthogonal to a user's neck, such as by applying a twisting motion to the therapeutic device. A therapeutic device may also be flipped so that a distal portion of a front contact surface is in contact with the anterior portion of a user's neck.

Figure 5:
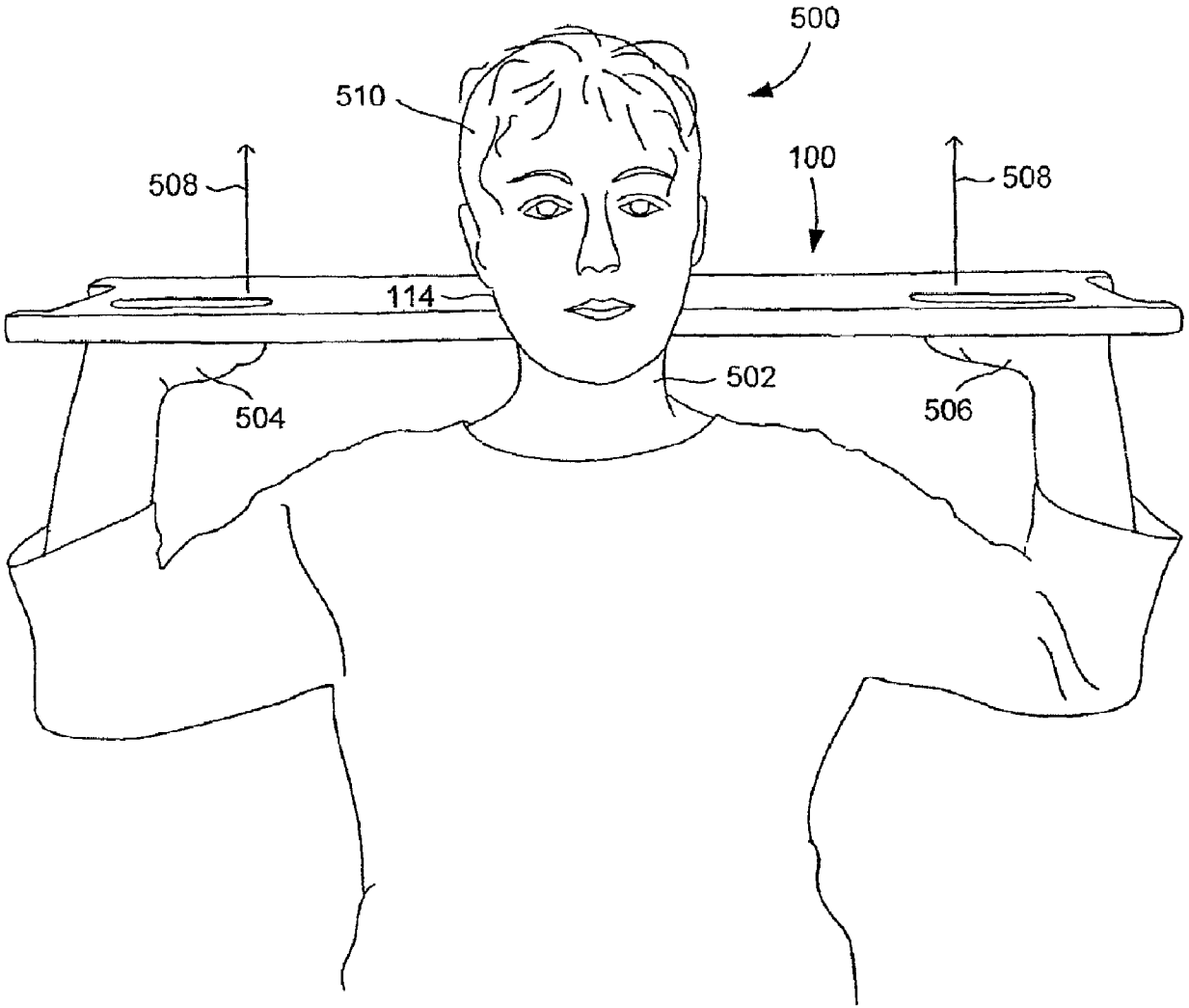
FIG. 5 shows a front view of a user stretching her spine by using the therapeutic device shown in FIG. 1 that represents one embodiment of the present invention.

A therapeutic device may also be used for providing traction by stretching the cervical portion of a user's spine. FIG. 5 shows a front view of a user stretching her spine by using the therapeutic device shown in FIG. 1 that represents one embodiment of the present invention. In FIG. 5, a user 500 is shown using the therapeutic device 100 for providing cervical traction. The user's neck 502 is positioned against the first cutout 114 and the user's hands 504 and 506 are positioned on the inferior side of the therapeutic device 100 and the user is pushing the therapeutic device 100 in a superior direction, as shown by directional arrows 508. As discussed above with reference to FIG. 4A, the therapeutic device 100 is sized such that the first cutout 114 fits snugly around the posterior half of the user's neck 502. The user's head 510, however, does not fit within the first cutout 114. When the first cutout 114 of the therapeutic device 100 abuts the superior portion of the user's neck 502, the therapeutic device 100 does not pass over the user's head 510 without a relatively large amount of force. The user 500 may continue to push the therapeutic device 100 in the superior direction 508 despite the user's head 510 blocking further superior movement. Accordingly, the superiorly-directed force applied by the user 500 serves to stretch the cervical portion of the user's spine. The user 500 may control the amount of pressure used to stretch her spine by controlling the amount of pressure applied to the therapeutic device 100 with her hands 504 and 506.

Figure 6:
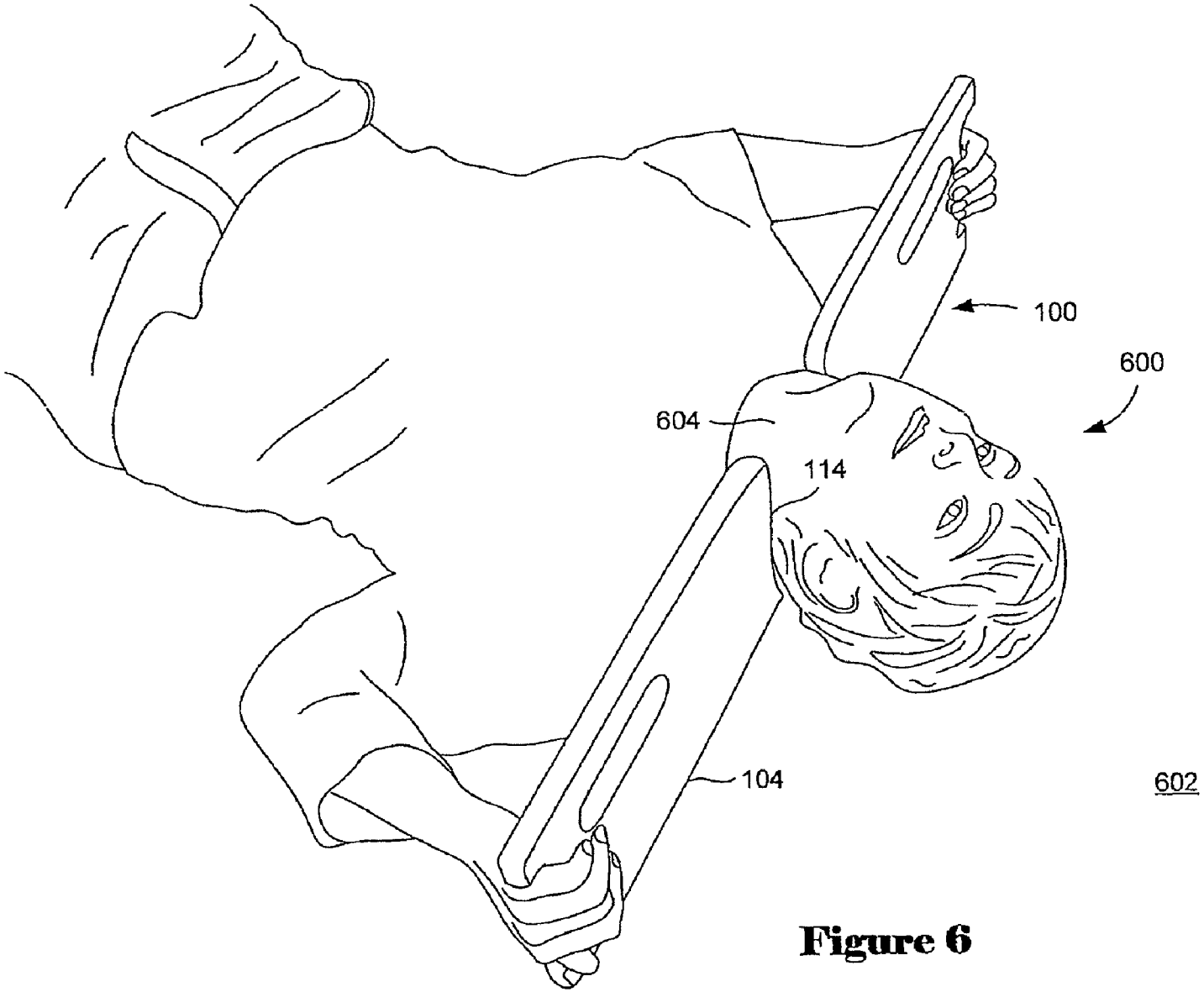
FIG. 6 shows a user massaging her neck while lying on her back and using the therapeutic device shown in FIG. 1 that represents one embodiment of the present invention.

The therapeutic device may also be used for massaging sore muscles and/or providing traction while the rear side of a therapeutic device is contacting a firm surface. For example, the rear side of a therapeutic device may be placed against a firm surface, such as a floor, and a user may lie on the floor with his or her neck positioned against the front contact surface of the therapeutic device. FIG. 6 shows a user massaging her neck while lying on her back and using the therapeutic device shown in FIG. 1 that represents one embodiment of the present invention. In FIG. 6, a user 600 is shown using the therapeutic device 100 while the user 600 is lying in a supine position against a floor 602. The user's neck 604 is positioned against the front contact surface 114 of the therapeutic device 100 while the rear side 104 of the therapeutic device 100 is flush with the floor 602. The user 600 may grasp the therapeutic device 100 and move the therapeutic device 100 either by angling the therapeutic device 100, as discussed above with reference to FIG. 4C, or by maintaining the therapeutic device 100 in an plane roughly orthogonal to the user's neck while moving the therapeutic device 100 in a superior and/or inferior direction along her neck 604, as discussed above with reference to FIGS. 4A, 4B, and 6. Alternately, the user 600 can hold the therapeutic device 100 stationary while moving her upper body superiorly and/or inferiorly over the first cutout 114 of the therapeutic device 100.

In one embodiment of the present invention, the distance between a distal portion of a first cutout and the rear side of a therapeutic device is sized so that, when a user is in a supine position with his or her neck placed against the first cutout of the therapeutic device that is also on the floor, as shown in FIG. 6, the posterior portion of the user's head contacts the floor without the need for the user to lean his or her head in a backwards direction. In another embodiment of the present invention, a therapeutic device includes a non-skid surface along a rear side of the therapeutic device to reduce the potential of the rear side of the therapeutic device slipping on a firm surface when the therapeutic device is being used in a manner that is similar to the use shown in FIG. 6.

Figure 7:
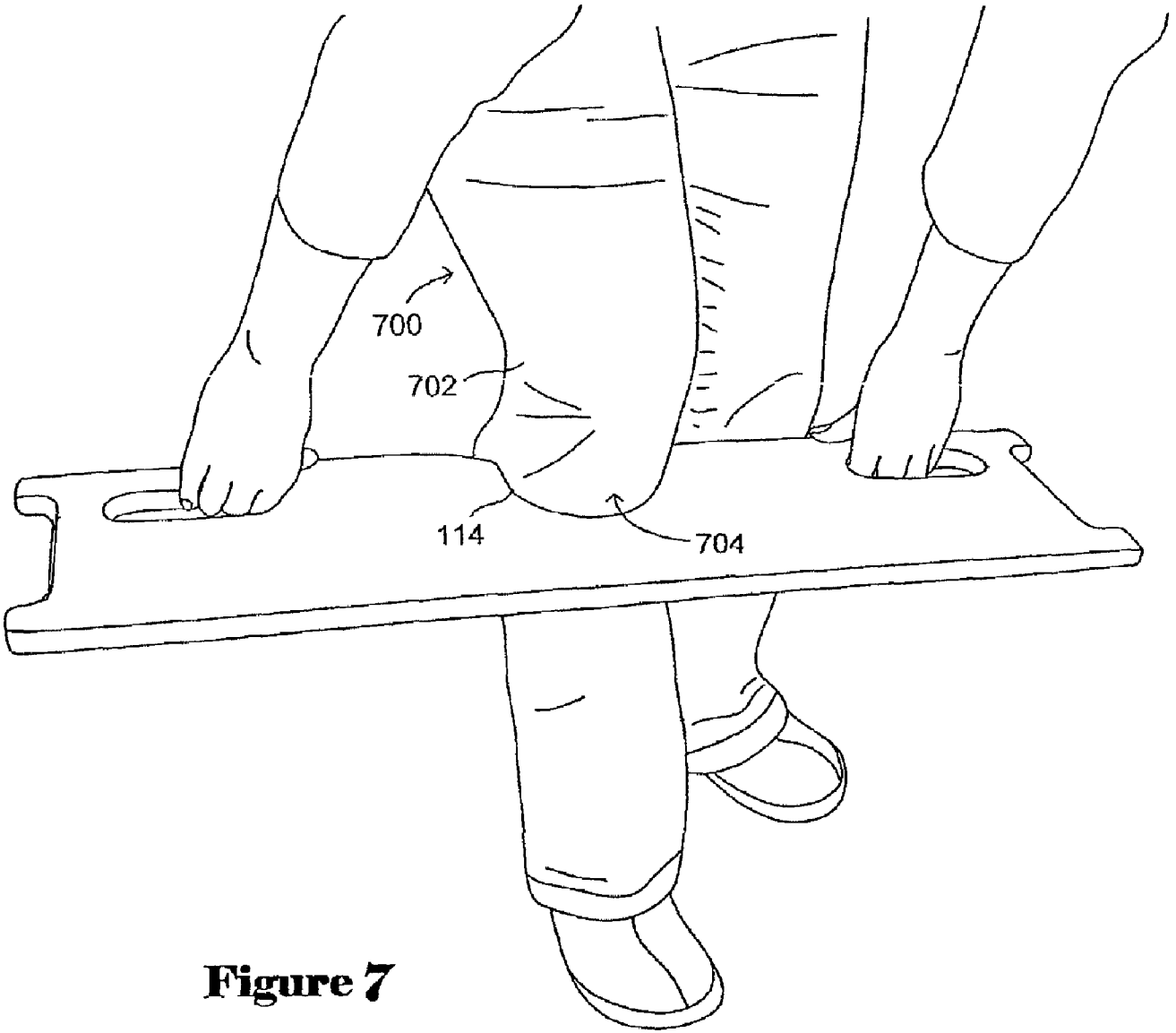
FIG. 7 shows a user massaging her lower limb using the therapeutic device shown in FIG. 1 that represents one embodiment of the present invention.

A front contact surface may be passed over muscle groups in body locations other than the neck, lower head, and shoulders. FIG. 7 shows a user massaging her lower limb using the therapeutic device shown in FIG. 1 that represents one embodiment of the present invention. In FIG. 7, a user 700 is shown using the therapeutic device 100 to massage her lower limb 702. The portion of the user's lower limb 702 over top of the user's patellar ligament 704 is contacting the first cutout 114 of the therapeutic device 100. The user 700 may move the therapeutic device 100 superiorly along her lower limb 702 to massage various muscle groups in the anterior proximal portion of her lower limb, including the vastus lateralis, vastus medialissartorius, gracilis, rectus femoris, sartorium, adductor longus, adductor magnus, adductor brevis, and other anterior-proximal-lower-limb muscle groups. The user 700 may also rotate the therapeutic device 100 horizontally and pass the first cutout 114 superiorly and inferiorly to massage various muscle groups in the posterior portion of her lower limb, including the semitendinosus, semimembranosus, biceps femoris, gastrocnemuis, soleus, and other posterior lower-limb muscle groups. Note that a user may similarly use a therapeutic device to massage various muscle groups in his or her upper limb to manage upper-limb musculoskeletal pain, including the biceps, triceps, brachioradialis, extensor carpi radialis brevis, extensor carpi radialis longus, extensor carpi ulnaris, flexor carpi ulnaris, extensor communis digitorum, and other upper-limb muscle groups.

In FIGS. 3A-7 a user is shown using a therapeutic device on herself. However, a therapeutic device can also be used by multiple people. For example, a first person may suffer from musculoskeletal pain in his or her neck. A second person may place the first cutout of a therapeutic device against the first person's neck and the second person may grasp one or more of the gripping surfaces and use the therapeutic device to massage the first person's neck in order to manage the first person's musculoskeletal pain.

Figure 8:
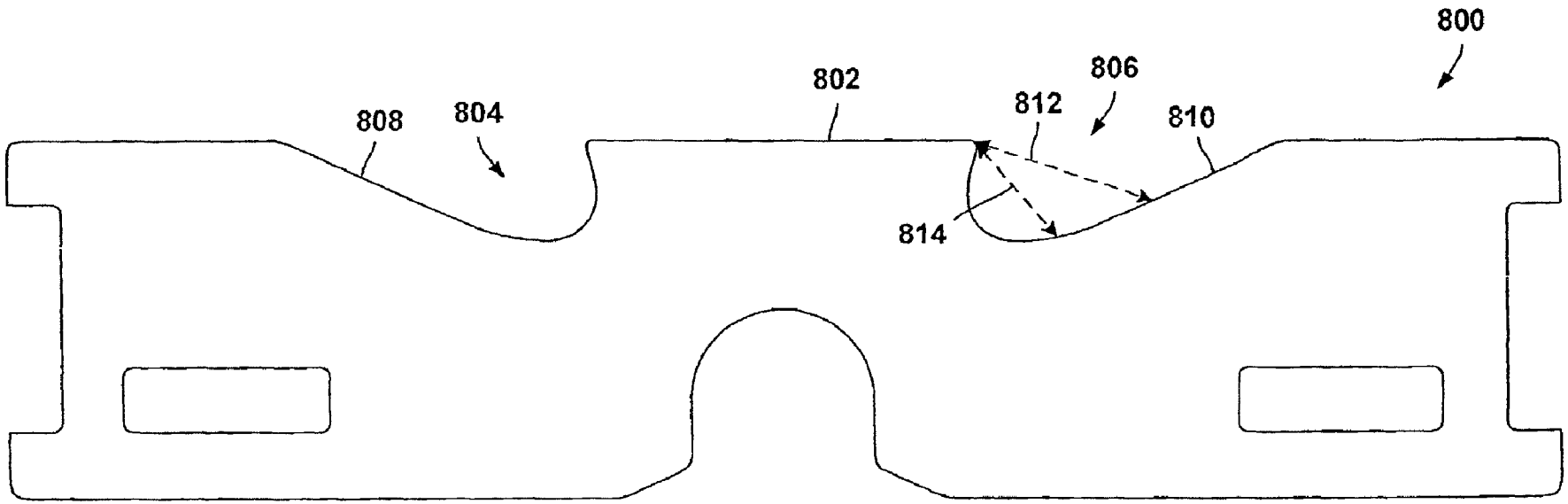
FIG. 8 shows a top view of a therapeutic device with multiple rear contact surfaces of a first type that represents one embodiment of the present invention.

Additional cutouts of various sizes and configurations may be added to a therapeutic device. FIG. 8 shows a top view of a therapeutic device with multiple rear auxiliary cutouts of a first configuration that represents one embodiment of the present invention. A therapeutic device 800 includes a rear side 802 (also referred to as a rear edge). The rear side 802 defines a first rear auxiliary cutout 804 and a second rear auxiliary cutout 806 displaced from the first rear auxiliary cutout. The first and the second rear auxiliary cutouts 804 and 806 each include slanted edges 808 and 810, respectively, which create variable available widths, such as widths 812 and 814, shown in FIG. 8 as dashed lines with arrows on both ends. By providing variable widths, body parts of different sizes may be massaged by the first and the second rear auxiliary cutouts 804 and 806, such as upper and lower limbs. As with the first cutout 114, each auxiliary cutout 804, 806 is defined by the rear side/edge 802 and presents an unconfined and unbounded opening that extends interiorly into the therapeutic device 100.

Figure 9:
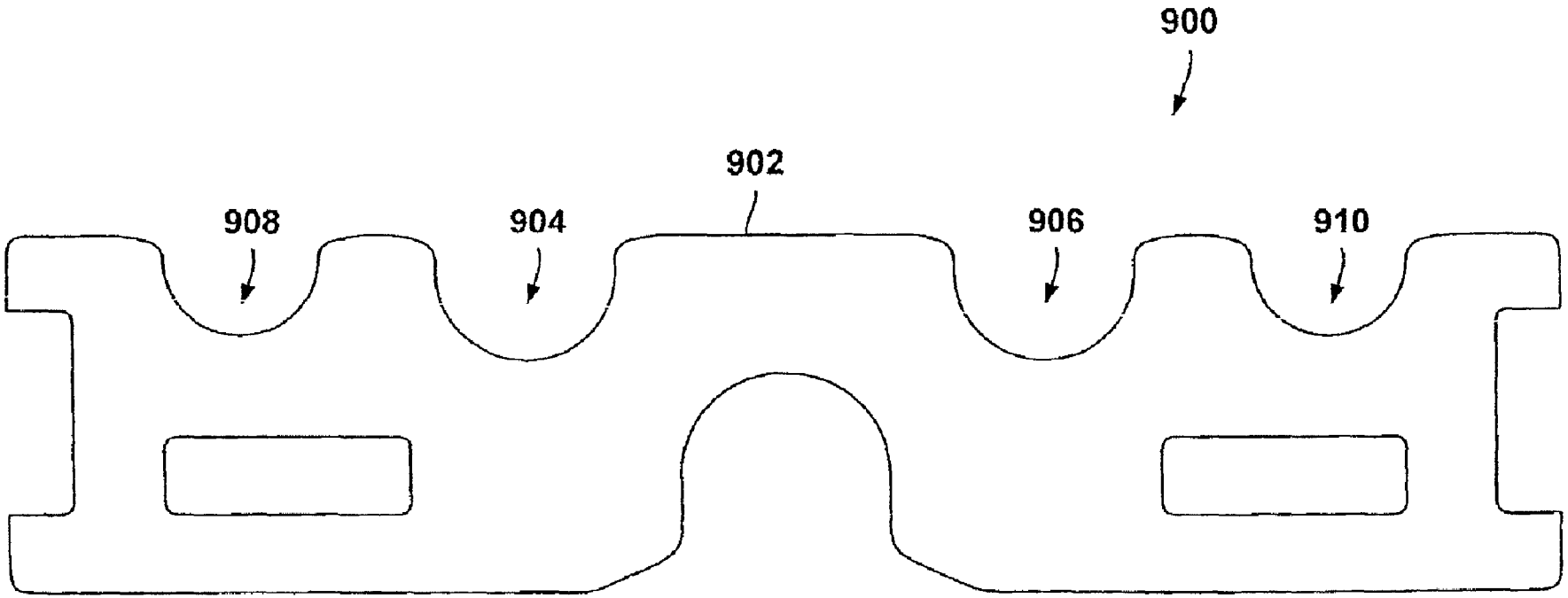
FIG. 9 shows a top view of a therapeutic device with multiple rear contact surfaces of a second type that represents one embodiment of the present invention.

FIG. 9 shows a top view of a therapeutic device with multiple rear auxiliary cutouts of a second type that represents one embodiment of the present invention. A therapeutic device 900 includes a rear side 902. The rear side 902 includes a first two similarly-sized inner rear auxiliary cutouts 904 and 906, and a second two similarly-sized outer rear auxiliary cutouts 908 and 910 of a different size from the first two similarly-sized inner rear auxiliary cutouts 904 and 906. In FIG. 9, the diameters of the inner rear auxiliary cutouts 904 and 906 are greater in size than the diameters of the outer rear auxiliary cutouts 908 and 910. In alternate embodiments of the present invention, the diameters of the inner rear auxiliary cutouts and smaller in size than the diameters of the outer rear auxiliary cutouts. In one embodiment of the present invention, the inner rear auxiliary cutouts and are sized to fit a user's lower limbs and the outer rear auxiliary cutouts and are sized to fit a user's upper limbs. In yet another embodiment of the present invention, each of four rear auxiliary cutouts has a different diameter and is sized to fit different portions of a user's body. For example a first rear auxiliary cutout is sized to fit the distal portion of a user's upper limb, a second auxiliary cutout is sized to fit the proximal portion of the user's upper limb, a third auxiliary cutout is sized to fit the distal portion of the user's lower limb, and the fourth auxiliary cutout is sized to fit the proximal portion of the user's lower limb. In additional embodiments of the present invention, additional auxiliary cutouts of various sizes are added to the front and/or rear sides to fit additional body parts, such as fingers and toes.

Figure 10:
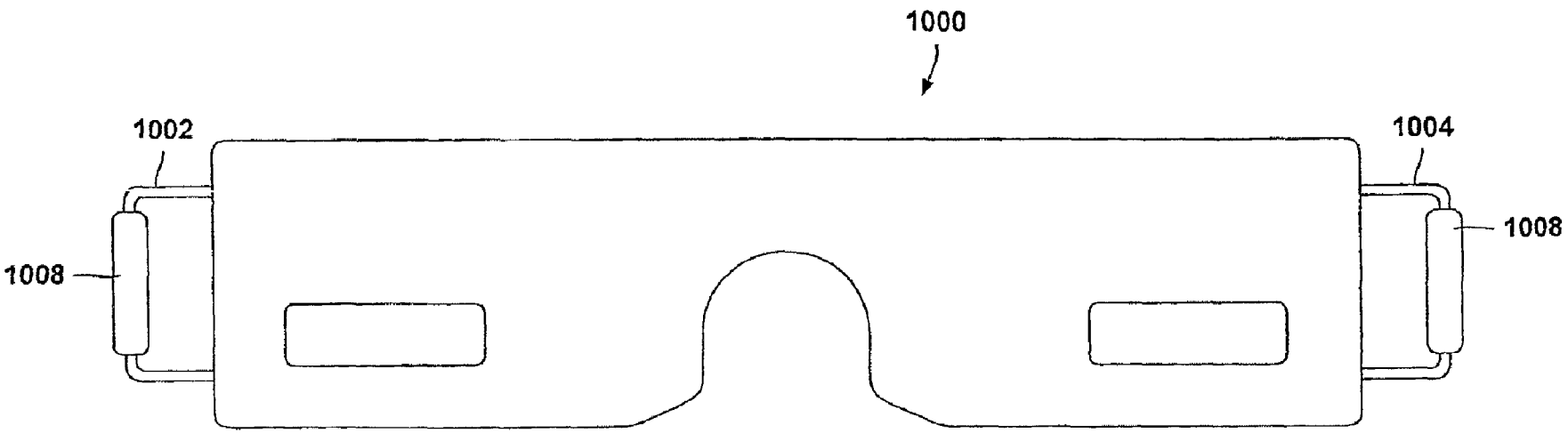
FIG. 10 shows a top view of a therapeutic device with an alternate type of outer gripping surfaces that represents one embodiment of the present invention.
Figure 11:
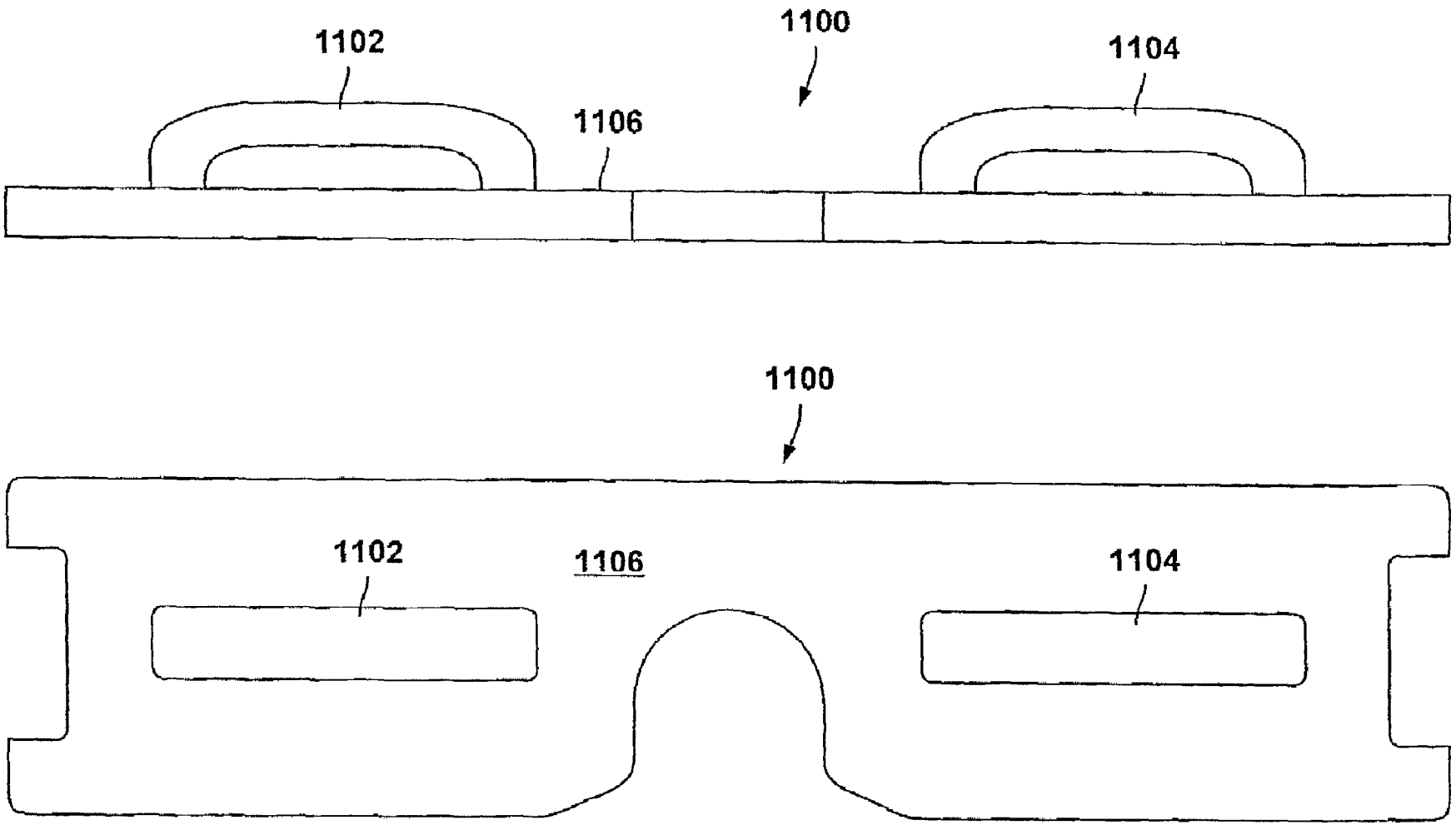
FIG. 11 shows a front view and a top view of a therapeutic device with an alternate type of inner gripping surfaces that represents one embodiment of the present invention.

Various types of gripping surfaces can be incorporated into a therapeutic device. FIG. 10 shows a top view of a therapeutic device with an alternate type of outer gripping surfaces that represents one embodiment of the present invention. In FIG. 10, a therapeutic device 1000 is shown with outer gripping surfaces 1002 and 1004 that include padded grips 1006 and 1008, respectively. FIG. 11 shows a front view and a top view of a therapeutic device with an alternate type of inner gripping surfaces that represents one embodiment of the present invention. In FIG. 11, a therapeutic device 1100 is shown with inner gripping surfaces 1102 and 1104. Inner gripping surfaces 1102 and 1104 each include a curved handle interconnected on each end of the curved handle to a first face 1106 of the therapeutic device 1100.

Figure 12:
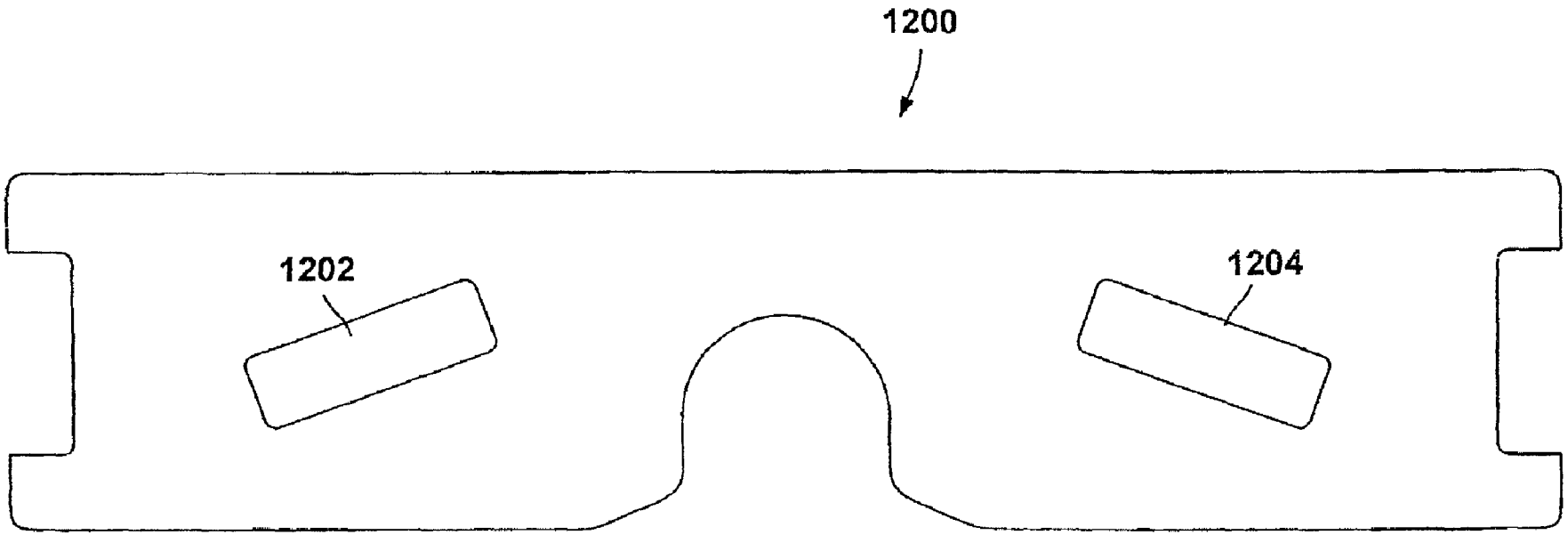
FIG. 12 shows a top view of a therapeutic device with alternate inner-gripping-surface placement that represents one embodiment of the present invention.

Gripping surfaces can be placed in various locations on a therapeutic device. FIG. 12 shows a top view of a therapeutic device with alternate inner-gripping-surface placement that represents one embodiment of the present invention. In FIG. 12, a therapeutic device 1200 is shown with inner gripping surfaces 1202 and 1204. Inner gripping surfaces 1202 and 1204 include apertures positioned in alternate locations from the inner gripping surfaces (132 and 134 in FIG. 1). Note that the therapeutic device shown in FIG. 12 is similar in shape to the therapeutic device 100 shown in FIG. 1. However, the inner-gripping-surface positioning shown in FIG. 12 may also be utilized with alternate therapeutic devices, such as the therapeutic devices 800 and 900 shown in FIGS. 8 and 9, respectively.

Figure 13:
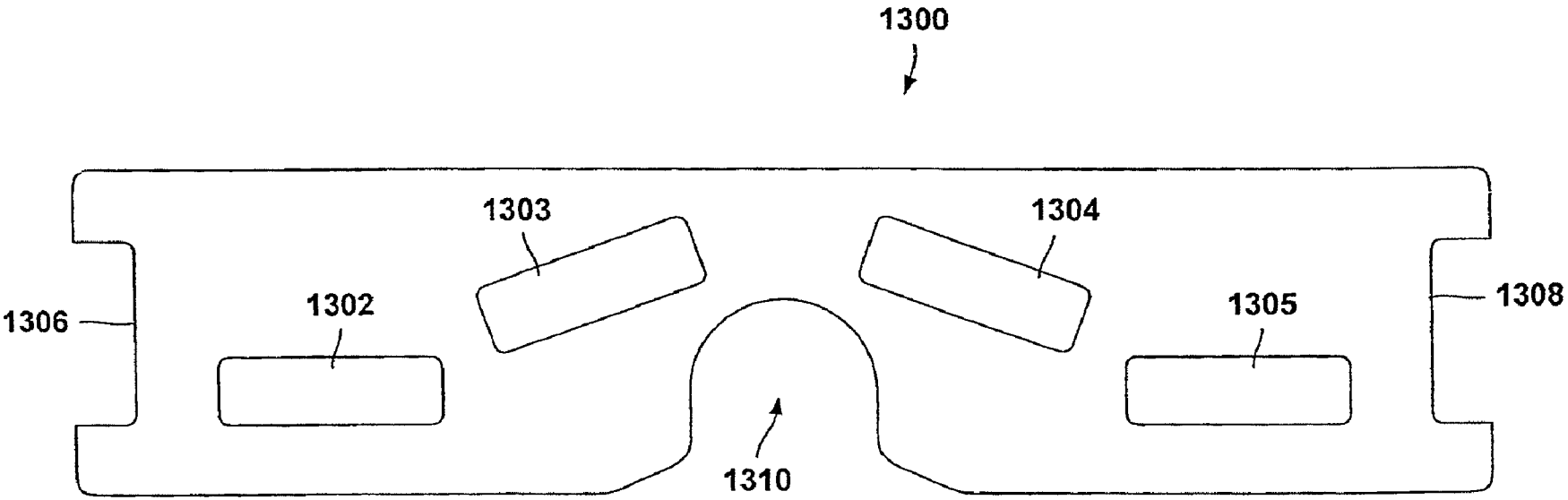
FIG. 13 shows a top view of a therapeutic device with two pairs of inner gripping surfaces that represents one embodiment of the present invention.

Additional gripping surfaces can also be included in a therapeutic device. FIG. 13 shows a top view of a therapeutic device with two pairs of inner gripping surfaces that represents one embodiment of the present invention. In FIG. 13, a therapeutic device 1300 is shown with four inner gripping surfaces 1302-1305 and two outer gripping surfaces 1306 and 1308. The inner gripping surfaces 1302 and 1303 are shown positioned between the outer gripping surface 1306 and a front contact surface 1310. The inner gripping surfaces 1304 and 1305 are shown positioned between the outer gripping surface 1308 and the front contact surface 1310. Accordingly, a user using therapeutic device 1300 may grip the therapeutic device 1300 with his or her hands in any two of the inner gripping surfaces 1302-1305 or on each of the outer gripping surfaces 1306 and 1308. Alternately, a user can place one of his or her hands on one of the inner gripping surfaces 1302-1305 and one of his or her hands on the outer gripping surfaces 1306 and 1308. Note that the therapeutic device shown in FIG. 13 is similar in shape to the therapeutic device 100 shown in FIG. 1. However, the inner gripping surfaces shown in FIG. 13 may also be utilized with alternate therapeutic devices, such as the therapeutic devices 800 and 900 shown in FIGS. 8 and 9, respectively.

Figure 14:
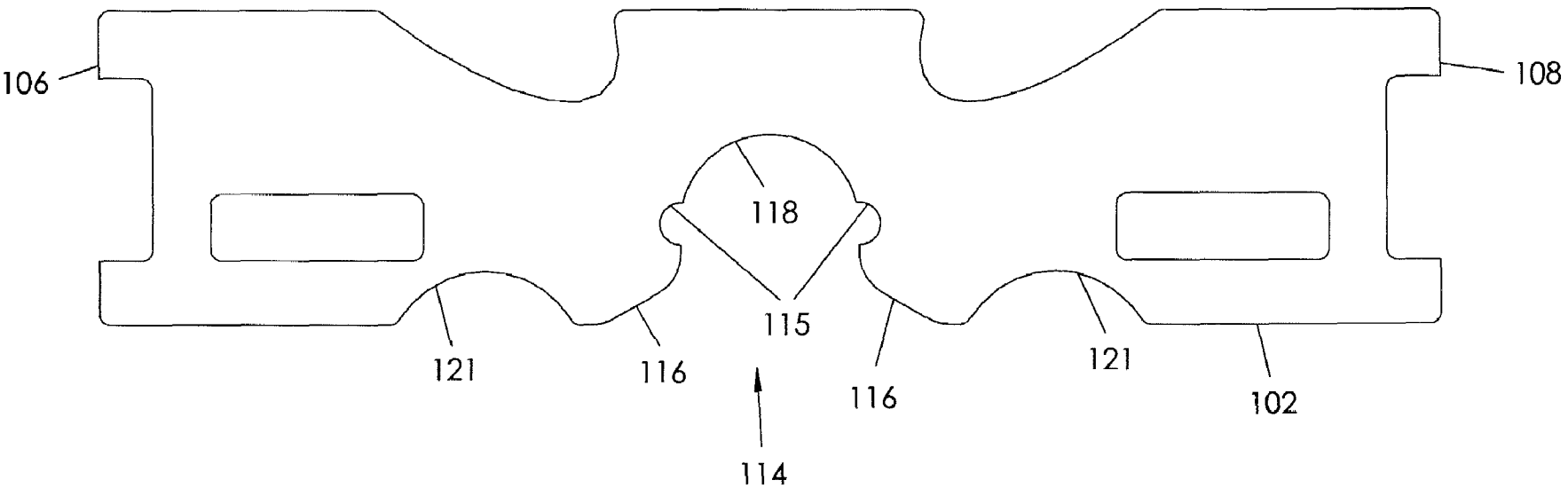
FIG. 14 shows a top view of a therapeutic device with pair of styloid/mastoid cutouts and pair of front flexion cutouts.

Further, the first cutout 114 defined by the front side/edge 102 of the device body includes a pair of oppositely disposed styloid/mastoid cutouts 115 (FIG. 14). More particularly, each styloid/mastoid cutout 115 is positioned between proximal 116 and distal 118 portions of the first cutout 114 (FIG. 1). Each styloid/mastoid cutout 115 includes a generally hemispherical configuration extending inwardly toward respective first 106 and second 108 ends of the device body. It is understood that the styloid/mastoid cutouts are necessary for the therapeutic device 100 to be used by a person wearing a traction collar or halo in contact with the mastoid processes of the skull.

Still further, the front side 102 of the device body defines a pair of front flexion cutouts positioned between the first cutout 114 and the first 106 and second 108 ends, respectively (FIG. 14). Each front flexion cutout 121 includes a generally hemispherical configuration that is open and unbounded by any other surface. It is understood that the pair of front flexion cutouts enables the device body to flex slightly when used to cause traction upon a user's neck as described in this application.

In addition to using a therapeutic device for massaging sore muscles and providing traction, a therapeutic device may also be used for improving posture, increasing range of motion, and to assist with stretching. For example, a user may position a front contact surface of a therapeutic device against the inferior, posterior portion of the user's neck, as shown in FIG. 4A. The user may provide pressure as needed against one or more sore muscle groups while moving his or her neck in various directions to stretch sore neck muscles to manage musculoskeletal pain and/or increase the range of motion of his or her neck. As another example of a stretching exercise, a user may stand up and place a therapeutic behind his or her calves. The user may grip the therapeutic device by either the inner gripping surfaces or the outer gripping surfaces and bend forward at the waist to stretch various lower-limb muscles.

Additional modifications within the spirit of the invention will be apparent to those skilled in the art. For example, a therapeutic device can be fabricated from a number of different rigid, durable materials, including wood, plastic, fiberglass, metal, composite, or other suitable rigid, durable material. An adhesive covering may be adhered to a therapeutic device to provide an alternate surface material from the material from which the therapeutic device is fabricated. A therapeutic device may vary in size and include different sizes of front and/or rear contact surfaces to fit various sizes of body parts of users of various sizes. A therapeutic device may be a number of different thicknesses and include routered edges along the gripping surfaces and/or the contact surfaces in order to increase comfort while using a therapeutic device. Additionally, padding may be placed along gripping surfaces and/or contact surfaces to increase comfort during use of a therapeutic device. Various complementary items can be used with a therapeutic device, including ice packs, heat packs, and vibrators.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purpose of illustration and description. They are not intended to be exhaustive or to limit the invention to the precise forms disclosed. Many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

The invention claimed is:

1. A multipurpose therapeutic device, comprising:

a device body having a generally rigid, rectangular, and planar configuration defining a length, a width, and a thickness, said device body comprising:

a top surface;

a bottom surface opposite to said top surface;

a front side extending longitudinally between said top and bottom surfaces;

a rear side extending longitudinally between said top and bottom surfaces opposite said front side, said rear side being generally parallel to said front side;

a first end generally orthogonal to and extending between respective ends of said front and rear sides;

a second end opposite said first end that is generally parallel to said first end and orthogonal to and extending between said front and rear sides;

wherein said first end defines an outer grip cutout, said outer grip cutout having an unconfined free surface;

wherein said second end defines an outer grip cutout, said outer grip cutout having an unconfined free surface;

a first inner grip including an elongated aperture in the device body;

a second inner grip including an elongated aperture in the device body and displaced from said first inner grip;

wherein said front side defines a first cutout having a generally annular configuration and an unconfined opening configured to receive a neck of a user;

wherein said rear side defines a pair of rear auxiliary cutouts displaced one from another, each rear side auxiliary cutout including slanted edges and defining an unconfined opening configured to receive a user's limb; and the first cutout includes a pair of spaced apart styloid/mastoid cutouts, each styloid/mastoid cutout having a generally hemispherical configuration extending inwardly in the direction of respective first and second ends of the device body.

2. The multipurpose therapeutic device of claim 1, wherein the front side of said device body defines a pair of front flexion cutouts, each of said pair of front flexion cutouts being positioned between the first cutout and a respective first and second end of the device body.

3. The multipurpose therapeutic device of claim 2, wherein each front flexion cutout includes a generally hemispherical configuration that is open and unbounded.

* * * * *